US010939508B2

(12) United States Patent
Imai et al.

(10) Patent No.: US 10,939,508 B2
(45) Date of Patent: Mar. 2, 2021

(54) COOKER

(71) Applicant: Panasonic Intellectual Property Management Co., Ltd., Osaka (JP)

(72) Inventors: Hirohisa Imai, Shiga (JP); Gantetsu Matsui, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 238 days.

(21) Appl. No.: 16/079,894

(22) PCT Filed: Mar. 7, 2017

(86) PCT No.: PCT/JP2017/008882

§ 371 (c)(1),
(2) Date: Aug. 24, 2018

(87) PCT Pub. No.: WO2017/154859

PCT Pub. Date: Sep. 14, 2017

(65) Prior Publication Data

US 2019/0053336 A1 Feb. 14, 2019

(30) Foreign Application Priority Data

Mar. 8, 2016 (JP) ..... JP2016-044165

(51) Int. Cl.

| | |
|---|---|
| ***H05B 6/64*** | (2006.01) |
| ***F24C 7/08*** | (2006.01) |
| ***H05B 6/68*** | (2006.01) |

(52) U.S. Cl.

CPC ..... *H05B 6/6441* (2013.01); *F24C 7/085* (2013.01); *H05B 6/6447* (2013.01); *H05B 6/687* (2013.01); *H05B 6/6411* (2013.01)

(58) Field of Classification Search

CPC ..... F24C 7/085; H05B 6/6411; H05B 6/6441; H05B 6/6447; H05B 6/687

(Continued)

(56) References Cited

U.S. PATENT DOCUMENTS 6,124,583 A * 9/2000 Bowers ..... H05B 6/6441 219/702
6,949,729 B1 * 9/2005 Ishikawa ..... H05B 6/688 219/702

(Continued)

FOREIGN PATENT DOCUMENTS

JP 3036671 U 5/1997
JP 2001-349546 12/2001

(Continued)

OTHER PUBLICATIONS

International Search Report of PCT application No. PCT/JP2017/008882 dated May 23, 2017.

(Continued)

*Primary Examiner* — Dana Ross
*Assistant Examiner* — Ket D Dang
(74) *Attorney, Agent, or Firm* — McDermott Will & Emery LLP

(57) ABSTRACT

A cooker is configured such that reader (19) reads heating control information attached to food from an image of an interior of heating chamber (12) captured by imaging unit (16), correction calculator (29) performs correction calculation based on the heating control information, and heating controller (14) controls heating unit (13) based on a result of the correction calculation.

10 Claims, 4 Drawing Sheets

(58) Field of Classification Search
USPC ..... 219/716, 506, 704, 714, 483–486, 497, 219/490, 518, 519, 412–414; 99/325–333; 700/211, 209, 207, 90; 126/19, 22; 432/91
See application file for complete search history.

(56) References Cited

U.S. PATENT DOCUMENTS

| | | | | |
|---|---|---|---|---|
| 2006/0289508 | A1* | 12/2006 | Kim | H05B 6/6441 219/714 |
| 2007/0007279 | A1* | 1/2007 | Chun | H05B 6/6441 219/506 |
| 2013/0306626 | A1* | 11/2013 | Torres | B65D 81/3446 219/635 |
| 2014/0231418 | A1* | 8/2014 | Ikeda | H05B 6/645 219/705 |
| 2015/0289324 | A1* | 10/2015 | Rober | H05B 6/68 219/711 |

FOREIGN PATENT DOCUMENTS

| | | | | |
|---|---|---|---|---|
| JP | 2002-243161 | | 8/2002 | |
| JP | 2014-070854 | | 4/2014 | |
| JP | 6007053 | B2 | 10/2016 | |
| KR | 20110129719 | A * | 12/2011 | H05B 6/705 |

OTHER PUBLICATIONS

English Translation of Chinese Search Report dated Mar. 20, 2019 for the related Chinese Patent Application No. 201780015037.3.

* cited by examiner

| W × SECONDS | HEATING POWER |
|---|---|
| LESS THAN 4000 | 200W |
| 4000 OR MORE AND LESS THAN 6000 | 400W |
| 6000 OR MORE AND LESS THAN 8000 | 600W |
| 8000 OR MORE AND LESS THAN 10000 | 800W |
| 10000 OR MORE AND LESS THAN 12000 | 1000W |
| 12000 OR MORE AND LESS THAN 14000 | 1200W |
| 14000 OR MORE AND LESS THAN 16000 | 1400W |
| 16000 OR MORE AND LESS THAN 18000 | 1600W |
| 18000 OR MORE | 1800W |

COOKER

TECHNICAL FIELD

The present disclosure relates to a cooker that heats food.

BACKGROUND ART

A microwave oven, which is a typical cooker, is convenient in that it can heat food disposed in a container without requiring use of a pot or a frying pan. Clerks at stores selling box lunches and side dishes or other food in containers may offer a service of heating purchased food in a microwave oven to provide heated food.

Such a heating service will be described below. The containers of box lunches and side dishes usually carry an indication of an optimum heating time for heating such food in a microwave oven. A store clerk checks the indication and sets the heating time in a microwave oven before heating the food. The microwave oven has an operation unit including numeric keys, for example, allowing manual setting of the heating time (minute, second).

In some cases, the microwave oven has a plurality of operation buttons, to which different heating times are allocated. In those cases, the store clerk selects a button corresponding to the food to be heated, thereby heating the food or the like under heating control suitable for that food, to provide heated food to the customer.

As in the former configuration, when a user sets a heating time (minute, second) using numeric keys, the user may find the setting cumbersome because of a number of operations required. In the latter configuration, that is, when different heating times are allocated to respective operation buttons of the microwave oven, the user may not be able to remember the correlations between the buttons and the heating times as food types increase.

To eliminate such cumbersomeness and errors, the following method has also been proposed. In the method, heating control contents for respective products are stored in a microwave oven in advance. A store clerk reads barcode information (code information) attached to a product with a barcode reader. In the microwave oven, a heating control content corresponding to that product is retrieved in accordance with the code information to perform suitable heating.

Another method using no barcode reader has also been proposed as described below. In this method, a microwave oven includes a camera that captures an image of an interior of the chamber. The microwave oven extracts a barcode portion from an image of a product placed in the chamber, and reads the barcode. From the read code information, a heating control content corresponding to the product is retrieved to perform suitable heating. These methods reduce clerks' operational workload to enable an error-free heating service (see PTL 1, for example).

Maximum output powers of microwave ovens vary among models. Thus, in order for a microwave oven to heat a product with its maximum output power in the shortest time, a correlation between the product and a heating time, derived from read code information, needs to be registered in the microwave oven in advance, and a content of the registered correlation varies among microwave oven models. The task of registering the correlation is cumbersome and may cause a registration error.

CITATION LIST

Patent Literature

PTL 1: Unexamined Japanese Patent Publication No. 2001-349546

SUMMARY OF THE INVENTION

The present disclosure has been made in view of the above problems, and provides a cooker that does not require a clerk to enter a heating time for a product or select a button corresponding to the product, but is capable of automatically setting the heating time, and also enables heating in different models having different maximum output powers at a suitable output power in accordance with the respective maximum output power.

Specifically, a cooker according to an exemplary embodiment of the present disclosure includes a heating chamber configured to house an object to be heated, a heating unit configured to heat the object to be heated housed in the heating chamber; and an imaging unit configured to capture an image of an interior of the heating chamber. The cooker according to an exemplary embodiment of the present disclosure also includes a reader configured to read heating control information given to the object to be heated, a correction calculator configured to correct the heating control information read by the reader, and a heating controller configured to control the heating unit based on a result of calculation performed by the correction calculator.

With this configuration, when the object to be heated, as a heating target, is put into the heating chamber of the cooker, the heating control information given to the object to be heated is read, the correction calculator performs correction calculation based on the heating control information, and the heating controller controls the heating unit based on a result of the correction calculation, to heat the object to be heated. In this way, a suitable heating time corresponding to a heating power of the cooker is automatically set to heat the object to be heated.

DESCRIPTION OF EMBODIMENT

Figure 1:
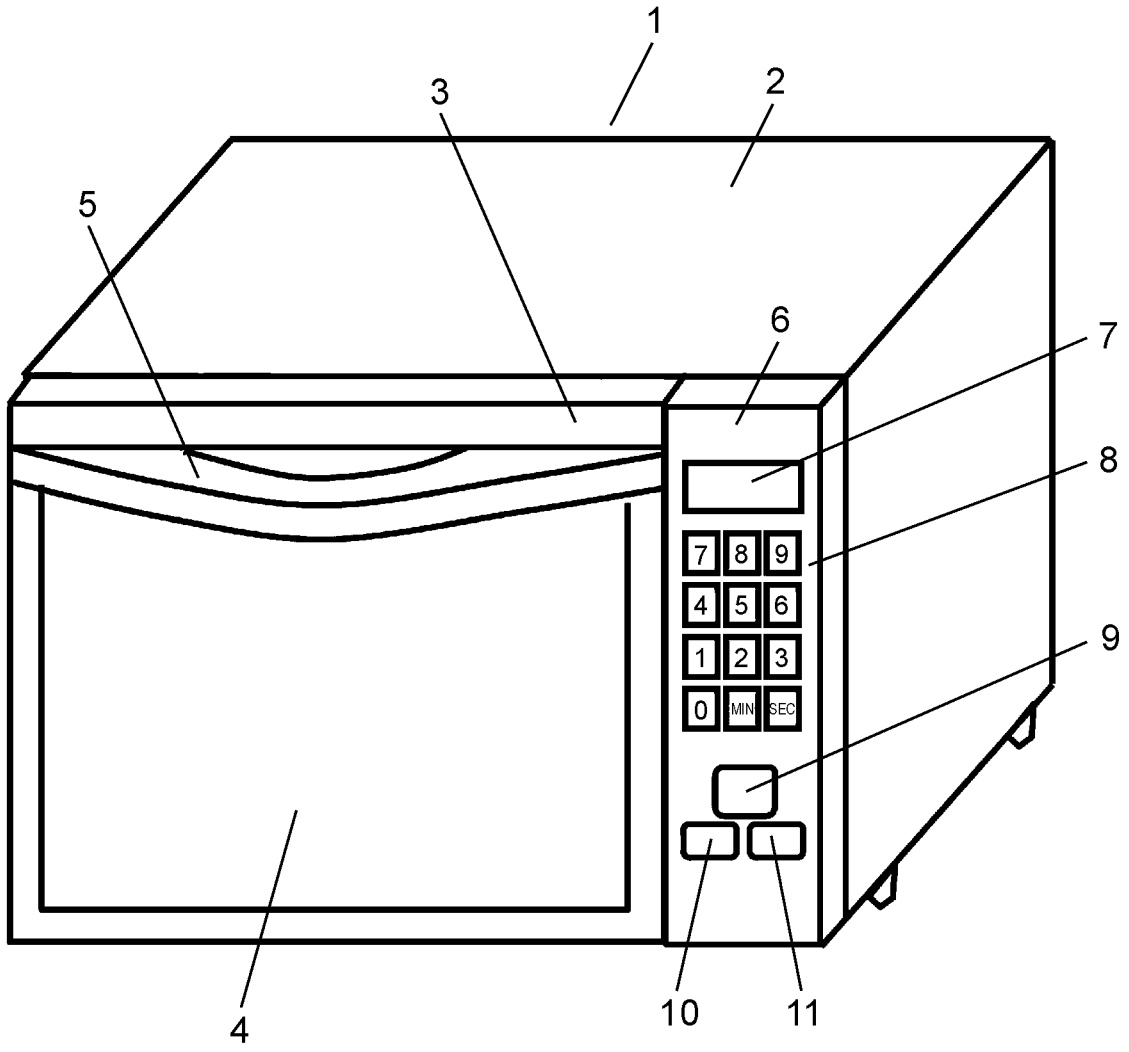
FIG. 1 is a perspective view illustrating an appearance of a microwave oven as an example of a cooker according to an exemplary embodiment of the present disclosure.

A cooker according to an exemplary embodiment of the present disclosure includes a heating chamber configured to house an object to be heated, a heating unit configured to heat the object to be heated housed in the heating chamber, and an imaging unit configured to capture an image of an interior of the heating chamber. The cooker according to an exemplary embodiment of the present disclosure also includes a reader configured to read heating control information given to the object to be heated, a correction calculator configured to correct the heating control information read by the reader, and a heating controller configured to control the heating unit based on a result of calculation performed by the correction calculator.

With this configuration, the reader reads the heating control information given to the food from the image of the interior of the heating chamber captured by the imaging unit, the correction calculator performs correction calculation based on the heating control information, and the heating controller controls the heating unit based on a result of the correction calculation. In this way, a suitable heating time corresponding to a heating power of the cooker is automatically set to heat the object to be heated.

In the cooker according to an exemplary embodiment of the present disclosure, the heating control information may contain heating power information, and heating time information about a heating time corresponding to the heating power information. In the cooker according to an exemplary embodiment of the present disclosure, the correction calculator may include a power conversion unit configured to convert the heating time information in the heating control information to heating time information corresponding to heating power information different from the heating power information in the heating control information, by using the heating power information and the heating time information in the heating control information read by the reader.

With this configuration, the power conversion unit converts the heating time information read by the reader to heating time information for heating power information different from the heating power information read by the reader. Thus, the object to be heated can also be heated with a heating power different from the heating power given to the object to be heated. This enables heating to be also performed with a higher heating power for a suitable time.

The cooker according to an exemplary embodiment of the present disclosure may include a switching unit configured to select the heating power information different from the heating power information in the heating control information, in accordance with the heating power information and the heating time information in the heating control information read by the reader. In the cooker according to an exemplary embodiment of the present disclosure, the heating controller may be configured to control the heating unit such that a heating power corresponding to the heating power information selected by the switching unit is output.

With this configuration, the switching unit properly selects the heating power in accordance with the heating power information and the heating time information read by the reader. Thus, the suitable heating power is selected in accordance with a size or heat load of the object to be heated. In addition, heating can be performed for a heating time suitable for that heating power.

An exemplary embodiment of the present disclosure will be described below with reference to the drawings. The following exemplary embodiment should not be construed to limit the scope of the present disclosure.

Exemplary Embodiment

FIG. 1 is a perspective view illustrating an appearance of a microwave oven as an example of a cooker according to an exemplary embodiment of the present disclosure. As illustrated in FIG. 1, microwave oven 1 has door 3 which allows food to be put into and taken out from housing 2 which is provided to store food. Door 3 has transparent glass window 4 which allows an interior of housing 2 to be seen from outside, handle 5 grasped by a user to open or close door 3, and operation display unit 6.

Operation display unit 6 includes liquid crystal display unit 7, time-setting button group 8, heating start button 9, cancel button 10, and pause button 11. As described later, microwave oven 1 captures an image of a product as a heating target (an object to be heated) with an imaging unit, reads a heating time indicated on the product, performs correction calculation on the heating time, and heats the product for the calculated heating time.

Liquid crystal display unit 7 displays the heating time obtained by performing the correction calculation on the read heating time. Microwave oven 1 has time-setting button group 8 for use when microwave oven 1 fails to read a heating time or when a product to be heated carries no indication of a heating time, for example. The user can set a heating time by using numeric buttons and "minute" and "second" buttons of time-setting button group 8. In this case, liquid crystal display unit 7 displays the set heating time.

Heating start button 9 is a button pressed by the user to start heating after the user checks the heating time displayed on liquid crystal display unit 7. Cancel button 10 is a button pressed after the user has pressed heating start button 9 and started heating, to stop the heating being performed, or to cancel the setting of the heating time being displayed on liquid crystal display unit 7. Pause button 11 is a button pressed by the user to temporarily stop the heating being performed. The user who has paused the heating can resume the heating at the point of pause by pressing heating start button 9 again.

Figure 2:
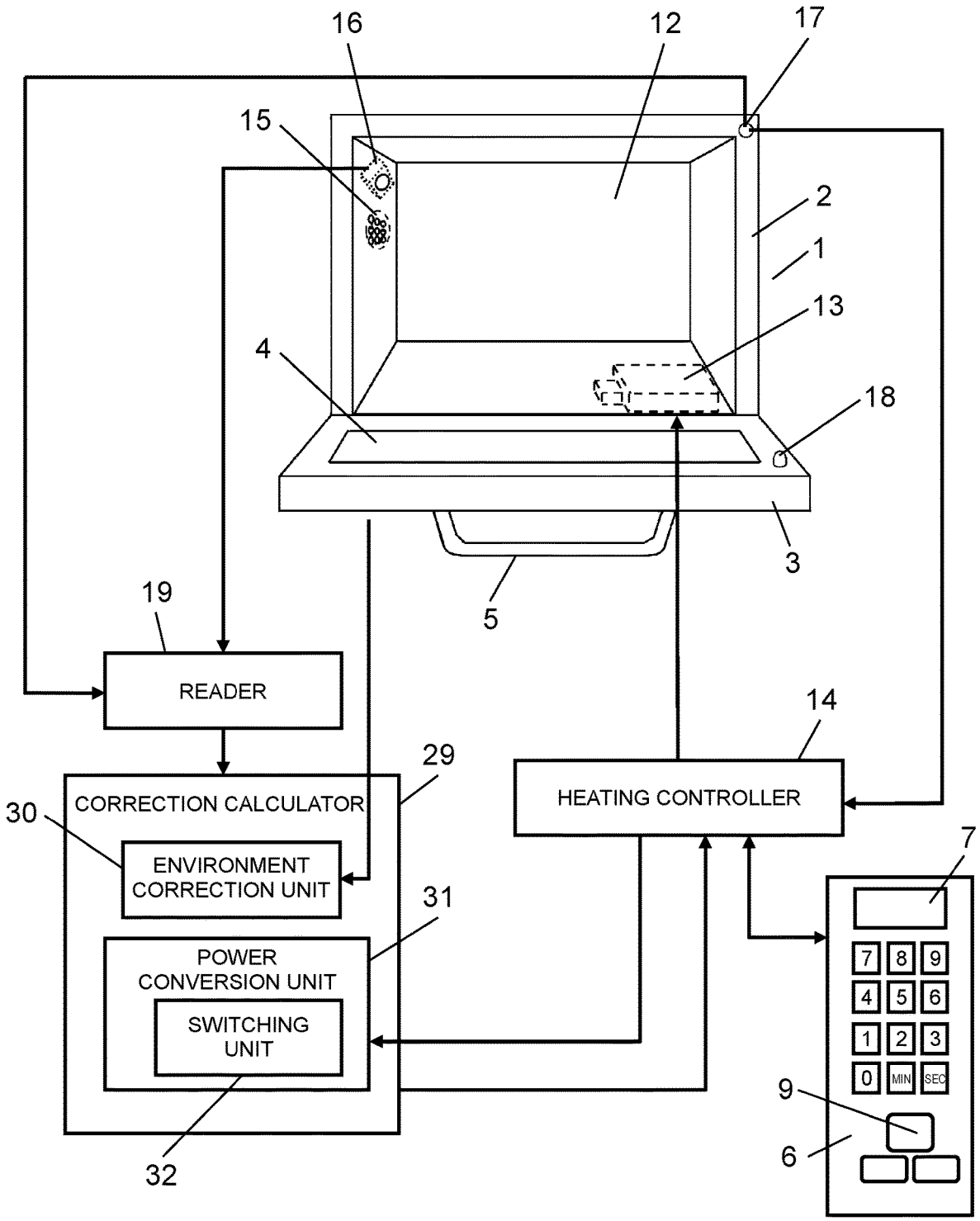
FIG. 2 illustrates a schematic configuration of the microwave oven according to the exemplary embodiment of the present disclosure.

FIG. 2 illustrates a schematic configuration of microwave oven 1 according to an exemplary embodiment of the present disclosure. Microwave oven 1 according to the exemplary embodiment of the present disclosure is capable of high-frequency heating of food and the like. As illustrated in FIG. 2, microwave oven 1 includes heating chamber 12 that houses an object to be heated, such as food, and magnetron 13 provided in heating chamber 12 to function as a heating unit that outputs a high frequency. In microwave oven 1, food is heated by supplying the high frequency from magnetron 13 to heating chamber 12. Microwave oven 1 also includes heating controller 14, which controls magnetron 13.

Further, microwave oven 1 has lamp 15 on one side. Microwave oven 1 also includes camera 16 as an imaging unit on the same side where lamp 15 is provided. Camera 16 captures an image of an interior of heating chamber 12. Since camera 16 is disposed on the same side as lamp 15, camera 16 can capture an image of the interior of heating chamber 12 without backlight. Housing 2 has door switch 17 provided to detect the opening and closing of door 3. Door 3 has protruding portion 18 to push door switch 17.

Examples of products (objects to be heated) put into heating chamber 12 include a box lunch, a rice ball, and a side dish. Such products each carry label 20, which indicates, as heating control information for the product, information about heating power (heating power information, which may hereinafter be simply referred to as a "heating power"), and information about heating time (heating time information, which may hereinafter be simply referred to as a "heating time").

Specifically, label 20 indicates two heating times for reference. One is a heating time for heating with a heating power of 500 W, for example, as a reference for heating in a typical home-use microwave oven. The other is a heating time for heating with a heating power of 1500 W, for example, as a reference for heating in a commercial-use microwave oven with a high heating power for a short time.

Figures 3, 4:
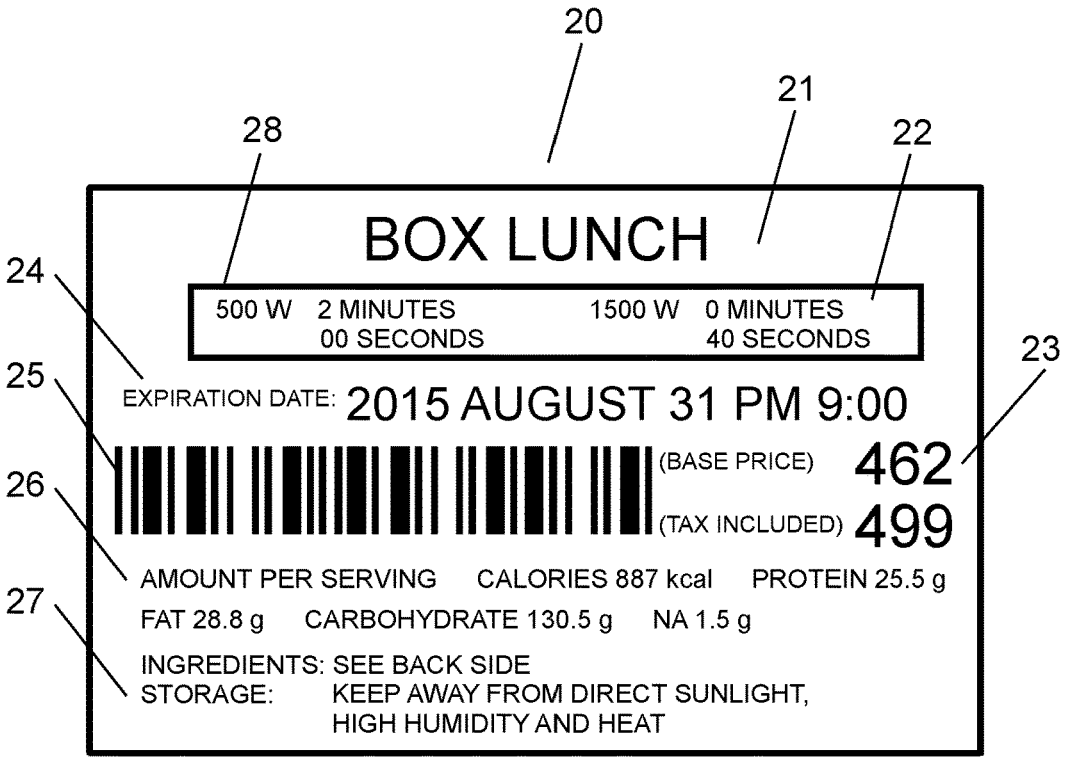
FIG. 3 illustrates an example of product information containing heating control information given to a product to be heated in the microwave oven according to the exemplary embodiment of the present disclosure.
FIG. 4 is an example of a correspondence table provided in the microwave oven according to the exemplary embodiment of the present disclosure, showing products of heating powers and heating times, and corresponding heating powers.

FIG. 3 illustrates an example of label 20 attached to a product. FIG. 3 illustrates an example of product information containing heating control information given to the product that is to be heated in microwave oven 1 according to an exemplary embodiment of the present disclosure.

The example in FIG. 3 indicates "500 W 2 minutes 00 seconds 1500 W 0 minutes 40 seconds", for example.

More specifically, the heating control information indicated on label 20 contains a character string that includes, in the following order, a first character string, for example, "500", which is a figure indicating an amount of heat at a predetermined heating power; a second character string, for example, "W", which indicates a unit of the heating power; a third character string, for example, "2", which is a figure being a heating time at the heating power; a fourth character string, for example, "minutes", which indicates a unit of the heating time; a fifth character string, for example, "00", which is a figure indicating the heating time at the heating power; and a sixth character string, for example, "seconds", which indicates a unit of the heating time.

The heating control information also contains a character string that includes, in the following order, a seventh character string, for example, "1500", which is a figure indicating an amount of heat at a heating power exceeding the aforementioned predetermined heating power; an eighth character string, for example, "W", which indicates a unit of the heating power; a ninth character string, for example, "0", which is a figure being a heating time at the heating power; a tenth character string, for example, "minutes", which indicates a unit of the heating time; an eleventh character string, for example, "40", which is a figure indicating the heating time at the heating power; and a twelfth character string, for example, "seconds", which indicates a unit of the heating time.

In the present exemplary embodiment, "watt (W)", which is a unit of heat amount specified by the International System of Units (SI), is used as the second character string and the eighth character string. However, any other character or unit may be used as long as the character or unit indicates a unit of heating power. Also, "minutes" or "seconds", which is characters indicating a unit of time, is used as the fourth character string, the sixth character string, the tenth character string, and the twelfth character string. However, any other character or unit may be used as long as the character or unit indicates a unit of time.

Reader 19 extracts a portion indicating the heating control information given to the product from an image captured by camera 16, and reads characters (characters including at least a figure) of the heating control information.

As illustrated in FIG. 3, label 20 indicates various information such as product name 21, heating control information 22, price information 23, expiration date information 24, barcode 25 as an example of a code symbol for product identification, nutrition information 26, and notice information 27. On label 20, mark frame 28, which is a rectangular location-specifying mark formed to surround the heating control information 22, is indicated for easy extraction of the heating control information 22 from the various information.

Reader 19 first extracts mark frame 28 from the image captured by camera 16. Reader 19 then reads the alphanumeric characters surrounded by mark frame 28 as a character string of "500W2001500W040". In the present exemplary embodiment, reader 19 does not read the characters that indicate the time units such as "minutes" and "seconds", or does not use these characters for interpretation even if reader 19 reads the characters.

Reader 19 then disassembles the character string into four number sequences in accordance with a predetermined interpretation rule. The four number sequences are a number sequence up to "W", a three-digit number sequence following "W", a number sequence following that number sequence up to "W", and a three-digit number sequence following "W", thereby obtaining "500", "200", "1500", and "040". For the second number sequence and the fourth number sequence of the four disassembled number sequences, reader 19 then interprets the first digit as "minutes" and the following two digits as "seconds". For the four disassembled number sequences, reader 19 also interprets the first number sequence as a heating power corresponding to the time of the second number sequence, and the third number sequence as a heating power corresponding to the time of the fourth number sequence. As a result, reader 19 reads the heating control information of "2 minutes at 500 W" and "40 seconds at 1500 W".

Referring back to FIG. 2, the description of the schematic configuration of microwave oven 1 according to the exemplary embodiment of the present disclosure is continued below. The user opens door 3 and puts a product into heating chamber 12. Once reader 19 detects the opening of the door with door switch 17, reader 19 reads heating control information as described above from an image of the interior of heating chamber 12 captured by camera 16.

Reader 19 sends the read heating control information to correction calculator 29. Correction calculator 29 includes environment correction unit 30 and power conversion unit 31. Environment correction unit 30 corrects the heating control information in accordance with a heating environment of microwave oven 1. For example, environment correction unit 30 detects power supply voltage, and when the detected power supply voltage is higher than rated voltage, environment correction unit 30 performs correction calculation to shorten the heating time. When the detected power supply voltage is lower than the rated voltage, environment correction unit 30 performs correction calculation to extend the heating time.

Next, power conversion unit 31 will be described. Differences in heating powers deliverable by microwave ovens at their respective maximum outputs (hereinafter referred to as "maximum output powers") will be first described. Typically, maximum output powers of microwave ovens vary among models. As for conventional, standard microwave ovens, home-use microwave ovens often have a maximum output power of 500 W, and commercial-use microwave ovens often have a maximum output power of 1500 W. However, there is always a demand from users for output of higher heating powers to shorten heating times. In view of this, recently marketed microwave ovens show an improvement in heating power conversion efficiency and thus have higher maximum output powers even when voltage and current that are fed to the microwave ovens as power supply are on the same level.

For example, microwave ovens on sale have maximum output powers, such as a maximum output power of 800 W for home-use microwave ovens, and a maximum output power of 1800 W for commercial-use microwave ovens. Accordingly, conventional microwave ovens (for example, home-use microwave ovens having a maximum output power of 500 W and commercial-use microwave ovens having a maximum output power of 1500 W), and microwave ovens that have been marketed recently (for example, home-use microwave ovens having a maximum output power of 800 W and commercial-use microwave ovens having a maximum output power of 1800 W) are mixed in the market. The maximum output powers of microwave ovens thus vary among models.

On the other hand, it is difficult to give, to a product, heating control information (for example, the heating power information and the heating time information indicated on label 20) that contains all possible combinations of various heating powers and heating times corresponding to those heating powers. Hence, the heating power information on label 20 may be indicated for the lower maximum output powers, which can be commonly used by both conventional microwave ovens having the lower maximum output powers, and recently marketed microwave ovens having the higher maximum output powers. For example, only two combinations are indicated; one is a combination of 500 W, which is a standard home-use heating power, and a heating time corresponding to 500 W, and the other is a combination of 1500 W, which is a standard commercial-use heating power, and a heating time corresponding to 1500 W.

Thus, for a microwave oven having a higher maximum output power, a user manually sets a heating time, which is shorter than the heating time (hereinafter referred to as an "indicated time") indicated on label 20, as a heating time for a heating power delivered at that maximum output power, and uses the set heating time. Alternatively, even with the microwave oven having the higher maximum output power, the user limits the heating power of the microwave oven and performs heating at the limited heating power as low as the heating power of conventional microwave ovens.

However, at a store which provides a heating service of heating purchased food in a microwave oven to provide the heated food, in particular, a clerk has difficulty in accurately setting a heating time that is different from the indicated time, while handling many customers. Due to this, the store clerk performs heating at a lower heating power corresponding to the indicated time, rather than heating at a maximum output power of the microwave oven. In that case, the high maximum output power deliverable by the microwave oven cannot be used, resulting in a failure to achieve a shorter heating time in the microwave oven.

To eliminate such a failure, microwave oven 1 according to the exemplary embodiment of the present disclosure includes power conversion unit 31 (see FIG. 2). Power conversion unit 31 receives, from reader 19, at least one combination of heating power information and heating time information indicated on label 20, as heating control information 22 given to the product. Power conversion unit 31 also receives, from heating controller 14, a numerical value of a maximum output power with which microwave oven 1 can provide heating. Power conversion unit 31 then performs correction calculation to convert the heating time information contained in heating control information 22 to heating time information corresponding to the maximum output power of microwave oven 1. Usually, in microwave oven 1, when total heating powers (each obtained as the product of a heating power and a heating time) applied to food are the same, the resulting heating is the same. Thus, the conversion may be performed such that the products of the heating powers and the heating times have an equal value.

To be specific, power conversion unit 31 divides the product of the heating power and the heating time corresponding to that heating power, contained in heating control information 22, by the maximum output power received from heating controller 14, thereby performing correction calculation to convert the heating time contained in heating control information 22 to a heating time corresponding to the maximum output power of microwave oven 1. For example, when reader 19 has read 1 minute 00 seconds as a heating time for 1500 W, power conversion unit 31 divides 90000 J, which is the product of 60 seconds (1 minute 00 seconds) and 1500 W, by 1800 W, which is the maximum output power received from heating controller 14, thereby obtaining a heating time of 50 seconds.

The correction calculation performed by power conversion unit 31 need not necessarily be calculation in which the product of the heating power and the heating time corresponding to that heating power, contained in heating control information 22, is divided by the maximum output power. In sum, the calculation may be performed by applying the combination of the heating power and the heating time corresponding to that heating power, contained in heating control information 22, and a relationship in which the heating power and the heating time corresponding to that heating power are inversely proportional to the maximum output power of microwave oven 1.

The following describes a case in which power conversion unit 31 receives, from reader 19, a plurality of combinations of heating power information and heating time information indicated on label 20 as heating control information 22 given to a product. For example, a product, such as a box lunch or a side dish, often carries an indication of two heating times for reference; one is a heating time for heating at 500 W, which is a reference for heating in a typical home-use microwave oven, while the other is a heating time for heating at 1500 W, which is a reference for heating in a commercial-use microwave oven having a higher heating power. In this case, power conversion unit 31 may perform the aforementioned correction calculation based on the combination of the lower heating power and the heating time corresponding to that heating power, or based on the combination of the higher heating power and the heating time corresponding to that heating power. The correction calculation based on either combination usually gives approximately the same result.

More desirably, of the combination of the lower heating power and the heating time corresponding to that heating power and the combination of the higher heating power and the heating time corresponding to that heating power, one combination that includes the heating power closer to the maximum output power received from heating controller 14 and the heating time corresponding to that heating power may be used by power conversion unit 31 to perform the correction calculation. For example, in microwave oven 1 having a maximum output power of 1800 W, when reader 19 has read "2 minutes" as the heating time corresponding to 500 W, and "40 seconds" as the heating time corresponding to 1500 W, power conversion unit 31 preferably calculates a heating time corresponding to 1800 W, based on 1500 W and the corresponding heating time of 40 seconds.

Next, switching unit 32 will be described. In the present exemplary embodiment, switching unit 32 is provided in power conversion unit 31. Alternatively, switching unit 32 may be provided outside power conversion unit 31. Typically, when an object to be heated, such as food, is very small, a heat load of the object to be heated is small. Thus, heating such a small object in a microwave oven with a low heating power does not cause a problem. However, when a small object is heated with a high heating power, the heating power output from magnetron 13 may not be transmitted to the food sufficiently, which may cause a reduction in heating power conversion efficiency. As in this case, when a high heating power is used for a small object to be heated, the aforementioned inversely proportional relationship between the heating power and the heating time does not hold. Hence, when a small amount of food is heated with a heating power delivered at a maximum output power, heating power that is not transmitted to the food may return to magnetron 13 to cause a temperature of magnetron 13 to rise, for example, and microwave oven 1 may be damaged.

To address such a situation, microwave oven 1 according to an exemplary embodiment of the present disclosure includes switching unit 32 (see FIG. 2). Switching unit 32 switches magnitude of the heating power that heating controller 14 outputs via magnetron 13, according to at least one of combinations of heating power information and heating time information indicated on label 20 as heating control information 22 given to the product.

For example, small food such as a rice ball may only carry an indication of one combination of a heating power and a heating time corresponding to that heating time, such as "500 W 20 seconds". This means that although heating in a home-use microwave oven having a maximum output power of about 500 W to 800 W may be recommended, heating in a commercial-use microwave oven having a high output power of 1500 W or above cannot be recommended. To be specific, if the aforementioned correction calculation is performed on the assumption that a commercial-use microwave oven having a maximum output power of 1800 W is used, the heating time is determined to be 5.6 seconds by dividing the product of 500 W and 20 seconds by 1800 W. However, heating with a heating power of 1800 W for 5.6 seconds is undesirable.

In microwave oven 1 according to the present exemplary embodiment, heating controller 14 is capable of heating an object to be heated at a plurality of levels of heating power via magnetron 13. For example, heating controller 14 is configured to be able to select one of nine heating powers ranging from the lowest output power of 200 W to the maximum output power of 1800 W in steps of 200 W.

Switching unit 32 is configured to switch to an optimum heating power in accordance with a heat load of the food, among the heating powers selectable by heating controller 14. Specifically, magnitude of the heat load of the food can be estimated from the product of the heating power and the heating time indicated on label 20. Switching unit 32 thus switches the magnitude of the heating power that heating controller 14 outputs via magnetron 13, in accordance with the product of the heating power and the heating time indicated on label 20.

For example, when the product of the heating power and the heating time is 10000 J, such as when the heating power and the heating time read by reader 19 are respectively 500 W and 20 seconds, a heating power up to 1000 W inclusive does not cause a drop in conversion efficiency. However, a heating power equal to or higher than 1000 W is not fully transmitted to the object to be heated, and causes a reduction in conversion efficiency. Accordingly, switching unit 32 selects 1000 W as the heating power to be output by heating controller 14.

Switching unit 32 selects the heating power according to a correspondence table for the product of the heating power and the heating time indicated on label 20, and an optimum heating power corresponding to that product. FIG. 4 illustrates an example of the correspondence table. FIG. 4 is an example of the correspondence table provided in microwave oven 1 according to an exemplary embodiment of the present disclosure, showing products of heating powers and heating times, and corresponding heating powers.

The correspondence table illustrated in FIG. 4 is determined in advance such that a heating power selected by switching unit 32 increases as the product of a heating power and a heating time increases. The correspondence table is stored in a memory unit (not shown) of microwave oven 1.

As illustrated in FIG. 4, the product of the heating power and the heating time indicated on label 20, and a corresponding optimum heating power are determined in a stepwise manner. For example, when the product of the heating power and the heating time is 10000 (W×seconds) or more, 12000 (W×seconds) or more, and 14000 (W×seconds) or more, the corresponding optimum heating powers are 1000 W, 1200 W, and 1400 W, respectively. Accordingly, switching unit 32 selects a maximum heating power that does not cause a drop in conversion efficiency, in accordance with the load of the food. This configuration enables microwave oven 1 to heat an object to be heated in a shorter time.

Switching unit 32 need not necessarily be provided in microwave oven 1 according to the present disclosure, and may not be provided.

Correction calculator 29 sends, to heating controller 14, the heating power selected by switching unit 32, and a heating time obtained by the aforementioned correction calculation based on that heating power, as heating control information obtained after the correction calculation. Heating controller 14 sends the heating control information obtained after the correction calculation to operation display unit 6. Operation display unit 6 displays, on liquid crystal display unit 7, the heating time of the heating control information obtained after the correction calculation.

After checking that the suitable heating time is displayed on liquid crystal display unit 7, the user closes door 3 and presses heating start button 9. Upon receiving a signal indicating the closing of door 3 from door switch 17, and a signal indicating the pressing of heating start button 9 from operation display unit 6, heating controller 14 performs heating control on magnetron 13 to heat the object to be heated, based on the heating power and the heating time contained in the heating control information received from correction calculator 29.

In FIG. 2, heating controller 14, reader 19, correction calculator 29, environment correction unit 30, power conversion unit 31, and switching unit 32 are configured by a microcomputer (not shown) including a central processing unit (CPU), random-access memory (RAM), and read-only memory (ROM).

The following describes operation steps of microwave oven 1 according to the present exemplary embodiment.

Figure 5:
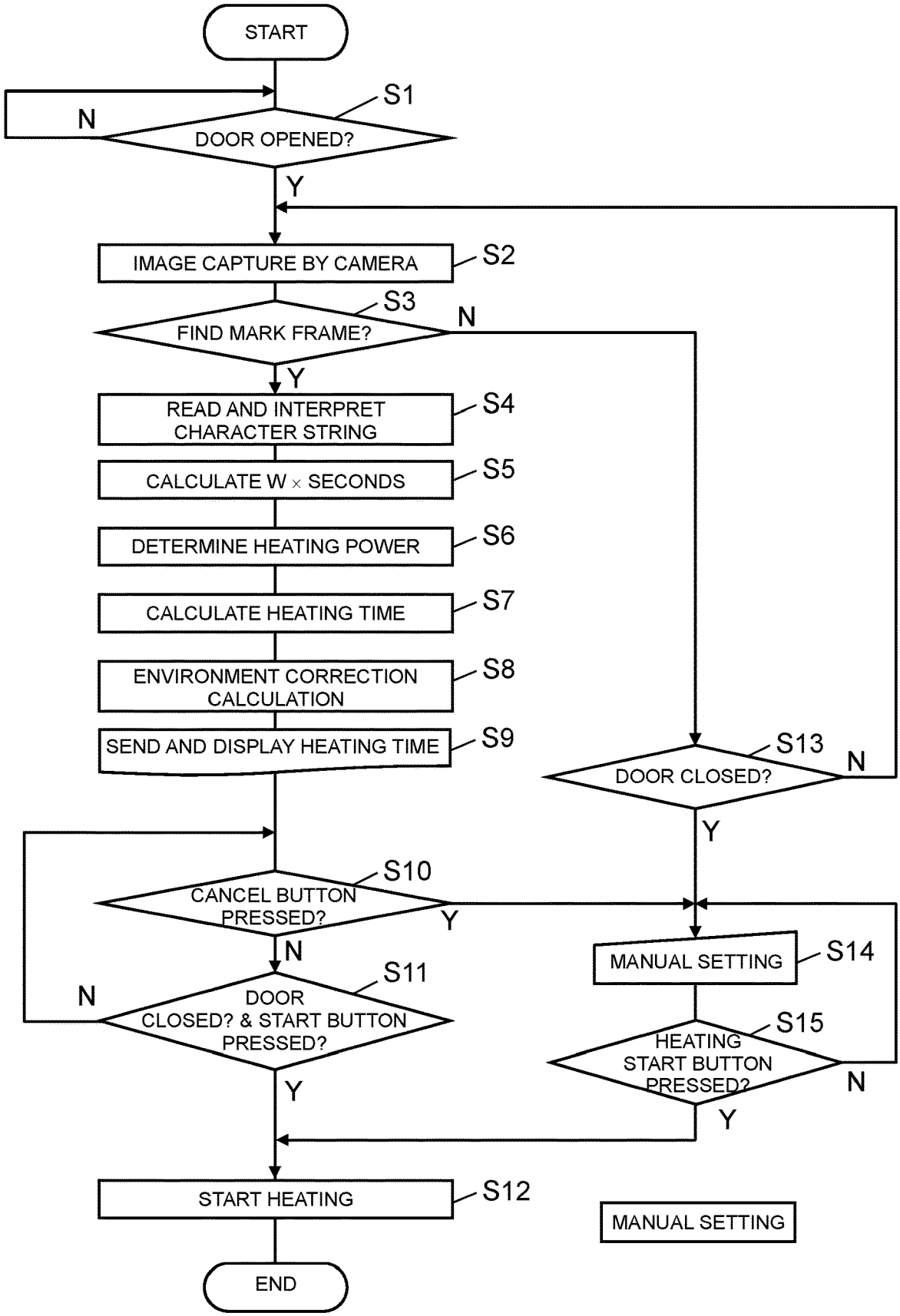
FIG. 5 is a flowchart illustrating a flow of operations of the microwave oven according to the exemplary embodiment of the present disclosure.

FIG. 5 is a flowchart illustrating a flow of operations of microwave oven 1 according to an exemplary embodiment of the present disclosure. Specifically, FIG. 5 illustrates a flow of operations of heating controller 14, reader 19, and correction calculator 29 of microwave oven 1.

First, in step S1, reader 19 determines whether door 3 is open, based on a state of door switch 17. If reader 19 determines that door 3 is open (YES in step S1), the process proceeds to step S2. On the other hand, if reader 19 determines that door 3 is closed (NO in step S1), reader 19 repeats step S1 and waits for door 3 to be opened.

In step S2, reader 19 captures an image of a bottom surface of heating chamber 12 with camera 16. The process then proceeds to step S3.

In step S3, reader 19 searches the image for mark frame 28. If reader 19 finds mark frame 28 (YES in step S3), the process proceeds to step S4. On the other hand, if reader 19 fails to find mark frame 28 (NO in step S3), the process proceeds to step S13.

In step S4, reader 19 reads alphanumeric characters surrounded by mark frame 28. In the example of the label illustrated in FIG. 3, reader 19 reads the character string of "500W2001500W040". Reader 19 then interprets the character string as two pieces of heating control information 22, i.e., "2 minutes at 500 W" and "40 seconds at 1500 W", according to a predetermined interpretation rule. The process then proceeds to step S5.

Next, in step S5 to step S8, correction calculator 29 performs correction calculation for heating control information 22. Correction calculator 29 is notified in advance by heating controller 14 that microwave oven 1 has a maximum output power of 1800 W. Then, in step S5, correction calculator 29 performs a multiplication in which, in the two pieces of heating control information 22, one of the heating powers that is closer to the maximum output power notified of by heating controller 14 is multiplied by the heating time corresponding to that heating power. Specifically, correction calculator 29 performs the multiplication of 1500×40=60000 by using the heating control information of 1500 W, which is closer to 1800 W, and 40 seconds corresponding to 1500 W.

Then, in step S6, switching unit 32 selects a heating power corresponding to the product of the heating power and the heating time calculated by heating controller 14, from the predetermined correspondence table showing the respective products of heating powers and heating times, and optimum heating powers corresponding to those products. Specifically, in the correspondence table of FIG. 4, 60000 (W×seconds) exceeds 18000, and thus switching unit 32 selects, as the heating power, 1800 W which corresponds to "18000 or more" in the field of the product of the heating power and the heating time.

Then, in step S7, power conversion unit 31 calculates a heating time corresponding to the heating power selected by switching unit 32. Specifically, 60000 J is divided by 1800 W, thereby calculating a heating time of 33.3 seconds.

Further, in step S8, environment correction unit 30 performs correction calculation, as an environment correction calculation, to shorten or extend the heating time, depending on whether power supply voltage detected by environment correction unit 30 is higher or lower than rated voltage. Specifically, environment correction unit 30 finds by calculation that the detected power supply voltage of 206 V is higher than the rated voltage of 200 V by 3%. Environment correction unit 30 then performs correction calculation to reduce the heating time of 33.3 seconds calculated by power conversion unit 31 by 3% to 32.3 seconds. Moreover, the fractional part of the heating time (seconds) is rounded off to whole numbers, thereby determining the heating time after the correction calculation as 32 seconds.

In step S9, correction calculator 29 sends 32 seconds to heating controller 14 as the heating time obtained by performing the aforementioned correction calculation. Heating controller 14 displays "1800 W, 32 seconds" on liquid crystal display unit 7 of operation display unit 6.

In step S10, heating controller 14 determines whether the user has pressed cancel button 10. If cancel button 10 has not been pressed (NO in step S10), the process proceeds to step S11. On the other hand, if cancel button 10 has been pressed (YES in step S10), the process proceeds to step S14.

The processing in step S10 is processing for performing heating for a heating time other than the heating time displayed on liquid crystal display unit 7, upon detection of the user's pressing of cancel button 10 when the user has checked the heating time displayed on liquid crystal display unit 7 to find the heating time incorrect, or when the user wants to perform heating using a different heating time.

In step S11, heating controller 14 determines, with door switch 17, whether door 3 is closed, and also determines whether heating start button 9 has been pressed. If the heating start button 9 has been pressed (YES in step S11), the process proceeds to step S12 to start heating. On the other hand, if heating start button 9 has not been pressed, or if the door is not closed, the process returns to step S10 where heating controller 14 repeats the processing of determination as to whether door 3 is closed, and whether cancel button 10 has been pressed.

If reader 19 fails to find mark frame 28 in step S3 (NO in step S3), the process proceeds to step S13. In step S13, reader 19 determines, with door switch 17, whether door 3 is closed. If reader 19 determines that door 3 is closed (YES in step S13), the process proceeds to step S14. On the other hand, if reader 19 determines that door 3 is not closed (NO in step S13), the process returns to step S2 to repeat the processing in and after step S2 (the image capture by camera 16).

Usually, the loop in which the process returns to step S2 from step S13 is repeated for a period of time from when the user opens door 3 to when food is put into and stands still in heating chamber 12.

Then, if cancel button 10 is pressed in step S10 (YES in step S10), and if door 3 is closed in step S13 (YES in step S13), the process proceeds to step S14. In step S14, heating controller 14 receives a heating time manually set by the user. This processing is processing for allowing the user to manually set the heating time using time-setting button group 8 when the user heats food that does not carry heating control information 22, or when reader 19 fails to read heating control information 22 due to stains, for example.

Then, in step S15, heating controller 14 determines whether heating start button 9 has been pressed. If heating controller 14 determines that heating start button 9 has been pressed (YES in step S15), the process proceeds to step S12 to start heating. On the other hand, if heating controller 14 determines that heating start button 9 has not been pressed (NO in step S15), the process returns to step S14 where the processing in which heating controller 14 receives the user's manual setting operation is repeated.

In this way, according to the present exemplary embodiment, reader 19 reads characters (including at least alphanumeric characters) of heating control information 22 indicated on the product, and heating controller 14 controls magnetron 13 in accordance with heating control information 22. This allows the automatic setting of the heating time, eliminating the need for the clerk to enter a heating time for the product or select a button corresponding to the product. Along with this, when microwave oven 1 is capable of outputting a heating power higher than the heating power given to the product, microwave oven 1 can heat the product at that maximum output power. Then, the product can be heated in a shorter heating time than the heating time given to the product.

Moreover, when microwave oven 1 according to the present exemplary embodiment includes switching unit 32, switching unit 32 selects a maximum heating power that does not cause a drop in efficiency, and a heating time for that heating power is calculated. Accordingly, in this case, a suitable heating power is selected in accordance with a heat load of the food, and the food can be heated for a heating time suitable for that heating power.

According to the above description of the present exemplary embodiment, heating control information 22 is characters (characters including at least alphanumeric characters). However, the present disclosure is not limited to this example. For example, other two-dimensional code such as barcode and QR code (registered trademark), or uniquely created code, in which heating control information 22 is encoded, may also be used. In such cases, an error detection bit, for example, may be added to further improve reading capacity.

According to the above description, environment correction unit 30 performs correction calculation in accordance with the heating environment of microwave oven 1 to thereby shorten or extend the heating time. However, the present disclosure is not limited to this example. For example, when microwave oven 1 is designed in view of variations in heating environment and thus can output a rated heating power even with the lowest power supply voltage, there is no need to extend the heating time. Hence, environment correction unit 30 may only perform a correction to shorten the heating time when power supply voltage is equal to or higher than a standard state, for example, rated supply voltage. Such a correction allows microwave oven 1 to perform heating with a heating power higher than the rated output power and thereby shorten the product's heating time.

In addition, in a case described according to the present exemplary embodiment, label 20 indicates two combinations of heating power information and heating time information. However, label 20 may indicate at least one combination of heating power information and heating time information.

Further, according to the above description, heating control information 22 is read from label 20 by reading alphanumeric characters surrounded by mark frame 28. However, the present disclosure is not limited to this example. Using a location-specifying mark of a predetermined shape, which is in a predetermined positional relationship with respect to heating control information 22, in place of mark frame 28 enables reading of heating control information 22 with high accuracy. The location-specifying mark may be a predetermined shape, such as a star, or a trade name or a mark of a store.

INDUSTRIAL APPLICABILITY

As described above, the present disclosure provides a cooker capable of reading heating control information given to a product that has been simply put into a heating chamber by a user, and capable of suitably heating the product in accordance with the heating control information. Therefore, the present disclosure is effectively applicable to cooking devices in general, such as home-use microwave ovens, rice cookers, and IH cooking heaters, as well as commercial-use microwave ovens used at stores which sell food and the like.

REFERENCE MARKS IN THE DRAWINGS

1: microwave oven
2: housing
3: door
4: glass window
5: handle
6: operation display unit
7: liquid crystal display unit
8: time-setting button group
9: heating start button
10: cancel button
11: pause button
12: heating chamber
13: magnetron (heating unit)
14: heating controller
15: lamp
16: camera (imaging unit)
17: door switch
19: reader
20: label
21: product name
22: heating control information
23: price information
24: expiration date information
25: barcode (code symbol)
26: nutrition information
27: notice information
28: mark frame
29: correction calculator
30: environment correction unit
31: power conversion unit
32: switching unit

The invention claimed is:

1. A cooker comprising:

a heating chamber configured to house an object to be heated;

a heating unit configured to heat the object to be heated housed in the heating chamber;

an imaging unit configured to capture an image of an interior of the heating chamber;

a reader configured to read, from an image of the object to be heated which is captured by the imaging unit, heating control information indicated on the object to be heated;

a correction calculator configured to correct the heating control information read by the reader; a switching unit configured to select a maximum heating power of the cooker that does not cause a drop in conversion efficiency of the cooker; and a heating controller configured to control the heating unit based on a result of calculation performed by the correction calculator to heat the object to be heated with an optimal maximum output power of the cooker, wherein the optimal maximum output power of the cooker is no higher than the maximum heating power of the cooker that does not cause the drop in conversion efficiency of the cooker.

2. The cooker according to claim 1, wherein the heating control information contains heating power information, and heating time information about a heating time corresponding to the heating power information; and the correction calculator includes a power conversion unit configured to convert the heating time information in the heating control information to heating time information corresponding to heating power information different from the heating power information in the heating control information, by using the heating power information and the heating time information in the heating control information read by the reader.

3. The cooker according to claim 2, wherein the switching unit is configured to select the heating power information different from the heating power information in the heating control information, in accordance with the heating power information and the heating time information in the heating control information read by the reader, and wherein the heating controller controls the heating unit such that the heating power information selected by the switching unit is output.

4. The cooker according to claim 1, wherein the correction calculator includes an environment correction unit and a power conversion unit.

5. The cooker according to claim 4, wherein the environment correction unit detects a power supply voltage of the cooker, and when the detected power supply voltage of the cooker is higher than a rated voltage in the heating control information given to the object to be heated, the environment correction unit performs a correction calculation to shorten a heating time for the object to be heated.

6. The cooker according to claim 4, wherein the environment correction unit detects a power supply voltage of the cooker, and when the detected power supply voltage of the cooker is lower than a rated voltage in the heating control information given to the object to be heated, the environment correction unit performs a correction calculation to extend a heating time for the object to be heated.

7. The cooker according to claim 4, wherein the power conversion unit performs a correction calculation to convert a heating time contained in the heating control information to a heating time corresponding to the maximum heating power of the cooker that does not cause the drop in conversion efficiency of the cooker.

8. The cooker according to claim 1, wherein the result of calculation performed by the correction calculator is based on a heat load of the object to be heated.

9. The cooker according to claim 1, wherein the heating controller is configured to heat the object to be heated at a plurality of levels of heating power.

10. The cooker according to claim 1, wherein a heating time applied to the object to be heated is shorter than a heating time in the heating control information indicated by the heating time information read by the reader.

* * * * *